US011026526B2

(12) United States Patent
Hummel

(10) Patent No.: US 11,026,526 B2
(45) Date of Patent: Jun. 8, 2021

(54) ADJUSTABLE BOWL RECEPTACLE

(71) Applicant: Sarah Hummel, Lebanon, OH (US)

(72) Inventor: Sarah Hummel, Lebanon, OH (US)

( * ) Notice: Subject to any disclaimer, the term of this patent is extended or adjusted under 35 U.S.C. 154(b) by 0 days.

(21) Appl. No.: 16/511,239

(22) Filed: Jul. 15, 2019

(65) Prior Publication Data

US 2020/0022513 A1 Jan. 23, 2020

Related U.S. Application Data

(60) Provisional application No. 62/699,463, filed on Jul. 17, 2018.

(51) Int. Cl.
*A47G 19/08* (2006.01)

(52) U.S. Cl.
CPC ..... *A47G 19/08* (2013.01)

(58) Field of Classification Search
CPC .... A47G 19/08; A47G 33/1226; A47G 19/30; A47G 19/302; A01K 5/0128; A01K 5/0135; A01K 7/005; B65D 85/62; B65D 21/086; B65D 21/0233; B65D 21/02; A47J 27/122
USPC ..... 220/575; 206/503
See application file for complete search history.

(56) References Cited

U.S. PATENT DOCUMENTS

| | | | | |
|---|---|---|---|---|
| 3,611,998 | A * | 10/1971 | Loscalzo | A01K 5/0114 119/61.54 |
| 6,688,485 | B1 * | 2/2004 | Lauer | A47G 19/02 220/574 |
| 9,079,453 | B1 * | 7/2015 | Cox | B44D 3/14 |
| D778,105 | S | 2/2017 | Coffey, Jr. | |
| 9,723,812 | B2 * | 8/2017 | Jones | F16M 11/041 |
| 10,093,445 | B1 * | 10/2018 | Hertz | B65D 21/0223 |
| 2007/0261641 | A1 * | 11/2007 | Manley-Hood | A01K 5/0128 119/61.5 |
| 2012/0085245 | A1 | 4/2012 | Hartman | |
| 2014/0348974 | A1 | 11/2014 | Fischell et al. | |
| 2016/0374485 | A1 * | 12/2016 | Peterson | A47G 19/02 220/575 |

* cited by examiner

*Primary Examiner* — Shawn M Braden
(74) *Attorney, Agent, or Firm* — Boudwin Intellectual Property; Daniel Boudwin

(57) ABSTRACT

An adjustable bowl receptacle. The adjustable bowl receptacle includes a planar base. A plurality of annular segments forms an adjustable sidewall that extends upward from the planar base. A top segment is in operable connection with the plurality of annular segments and defines an open upper end and an interface. The interface comprises a plurality of flanges configured to secure bowl therein.

6 Claims, 3 Drawing Sheets

ADJUSTABLE BOWL RECEPTACLE

CROSS REFERENCE TO RELATED APPLICATIONS

This application claims the benefit of U.S. Provisional Application No. 62/699,463 filed on Jul. 17, 2018. The above identified patent application is herein incorporated by reference in its entirety to provide continuity of disclosure.

BACKGROUND OF THE INVENTION

The present invention relates to an adjustable bowl receptacle. More specifically the present invention provides an adjustable bowl receptacle that enables a user to freely adjust the angle at which a bowl rests when placed into the adjustable bowl receptacle.

Bowls are commonly utilized vessels of foods and liquids for consumption. Typically, an individual will utilize a spoon to gather the ingredients of the bowl and transport them to his or her mouth for ingestion. As the level of the contents of the bowl is lowered, it will become more difficult for the individual to gather the contents of the bowl into a spoon. This is primarily a result of the shape of a common bowl as most bowls define a flattened base to allow for the bowl to rest on a flat surface, such as a table. Due to this flattened base, the individual may have to hold the bowl with one hand and tilt the bowl so that the contents will rest between the flattened base and the side walls of the bowl.

Many individuals may become frustrated or struggle when trying to tilt a bowl however. Particularly, individuals with physical limitations or limited hand dexterity may be unable to both hold a bowl in a tilted position and orient a spoon to gather the contents. Additionally, due to the typical fluidity of bowl contents, spills can result from this method. These problems may be exacerbated even more where the contents of the bowl are hot, such as soup. Therefore, there is a need for a device that will assist individuals in gathering the remaining contents of a bowl.

SUMMARY OF THE INVENTION

In view of the foregoing disadvantages inherent in the known types of adjustable bowl receptacles now present in the prior art, the present invention provides an adjustable bowl receptacle wherein the same can be utilized for providing convenience for the user when gathering the final contents of a bowl with a spoon.

The present system comprises a planar base. A plurality of annular segments forms an adjustable sidewall that extends upward from the planar base. A top segment is in operable connection with the plurality of annular segments and defines an open upper end and an interface. The interface comprises a plurality of flanges configured to secure a bowl therein.

In a further embodiment, it is an object of the present invention to provide an adjustable side wall that is telescopic in configuration or is in an accordion style configuration such that the top segment is freely movable by the user.

In another embodiment, it is an object of the present invention to provide a plurality of annular segments where each annular segment is curved such that the open upper end is oriented to be freely movable.

In a further embodiment, it is an object of the present invention to provide a planar base that is of a greater diameter than the open upper end such that increased stability is provided to the adjustable bowl receptacle.

In yet another embodiment, it is an object of the present invention to provide an adjustable bowl with a locking mechanism, such as a ball detent, so that the positioning of the adjustable bowl receptacle can be maintained.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
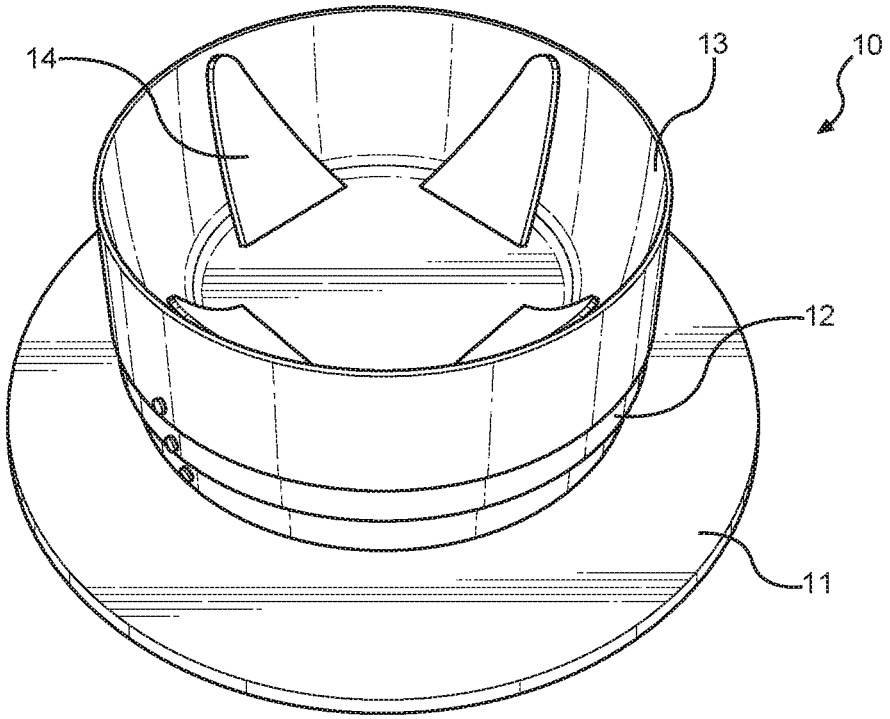
FIG. 1 shows a perspective view of an embodiment of the adjustable bowl receptacle.

Reference is made herein to the attached drawings. Like reference numerals are used throughout the drawings to depict like or similar elements of the adjustable bowl receptacle. The figures are intended for representative purposes only and should not be considered to be limiting in any respect.

Referring now to FIG. 1, there is shown a perspective view of an embodiment of the adjustable bowl receptacle. An adjustable bowl receptacle 10 comprises a planar base 11. The planar base 11 is configured to rest on a flat surface. In the illustrated embodiment, the planar base 11 is round, but in alternate embodiments, the planar base 11 may be of any desired shape. The planar base 11 is made of any suitable material. Ideally, the planar base 11 will be non-porous, durable and light in weight such that the adjustable bowl receptacle will be easy to use and easy to clean.

A plurality of annular segments 12 extend upward from the planar base 11, such that an adjustable sidewall is defined. The adjustable sidewall allows for free movement of the plurality of annular segments 12 such as to orient the adjustable bowl receptacle 10 between a closed position and an extended position. The plurality of annular segments 12 is made of any suitable material. Ideally, the plurality of annular segments 12 will be non-porous, durable and light in weight such that the adjustable bowl receptacle 10 will be easy to use and easy to clean. In the illustrated embodiment the plurality of annular segments 12 consists of two segments.

A top segment 13 is disposed on top of the plurality of annular segments 12 oppositely the planar base 11. The top segment 13 defines an open upper end. The open upper end is sized to receive a bowl therein, such that the bowl will rest in the top segment 13. In one embodiment, a perimeter of the planar base 11 is greater than a perimeter of the open upper end. When the perimeter of the planar base 11 is greater than the perimeter of the open upper end, greater stability is provided to the adjustable bowl receptacle 10.

Figure 2:
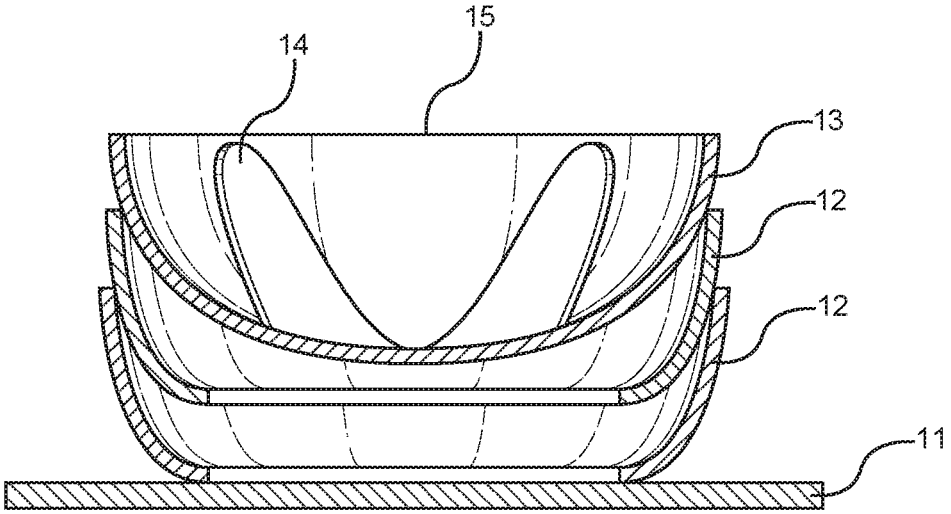
FIG. 2 shows a cross-sectional view of an embodiment of the adjustable bowl receptacle.

Referring now to FIG. 2, there is shown a cross-sectional view of an embodiment of the adjustable bowl receptacle. In the illustrated embodiment, the plurality of annular segments 12 are telescopically oriented. As such, the plurality of annular segments 12 can be freely movable by the user, such as to adjust the position of the open upper end 15 to adjust the angle at which a bowl sits in the top segment 13. In use, a user must be able to change the position of the top segment 13 while a bowl is placed in the top segment 13.

Additionally, the top segment 13 defines an interface configured to receive a bowl therein. The interface is configured to receive and frictionally secure a bowl therein. In the shown embodiment, the interface comprises a plurality of flanges 14. In one embodiment, the plurality of flanges 14 are made of a material providing an increased frictional coefficient. In another embodiment, the plurality of flanges 14 is integral to the top segment 13. The plurality of segments, in the illustrated embodiment are defined by a base that tapers upward toward a rounded top. As such, greater stability is provided to a bottom portion of a bowl than a top portion of the bowl. Such support is desirable as a bowl is heavier at the bottom portion, particularly when the bowl has contents, such as food therein.

Figure 3:
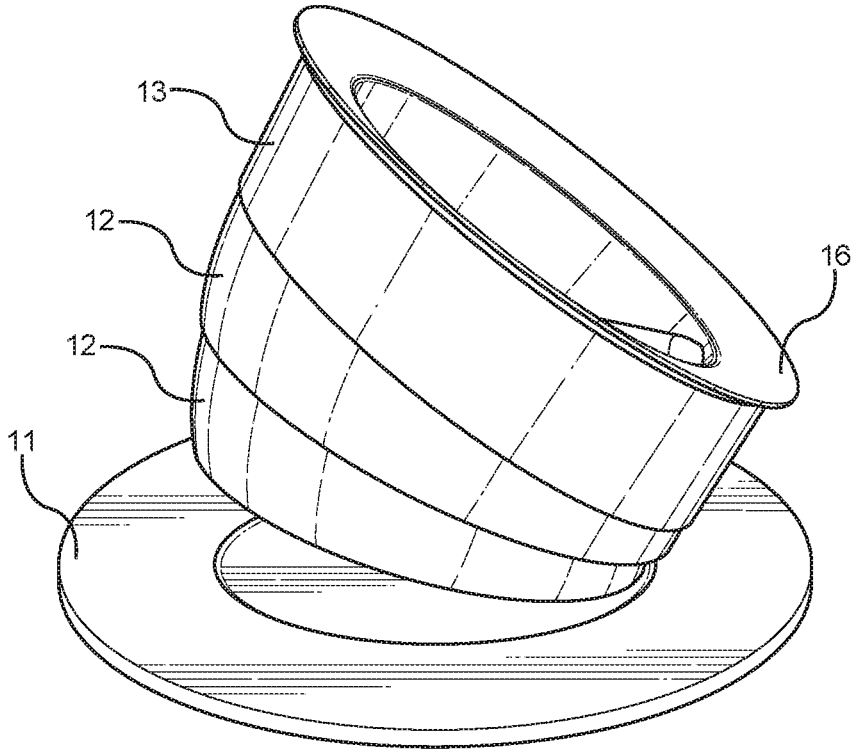
FIG. 3 shows a perspective view of an embodiment of the adjustable bowl receptacle in an extended position.

Referring now to FIG. 3, there is shown a perspective view of an embodiment of the adjustable bowl receptacle in an extended position. The adjustable bowl receptacle 10 is freely movable between a closed position (shown in FIG. 1) and an extended position. In the extended position, the adjustable sidewall is selectively retractable to a desired angle.

Figure 4:
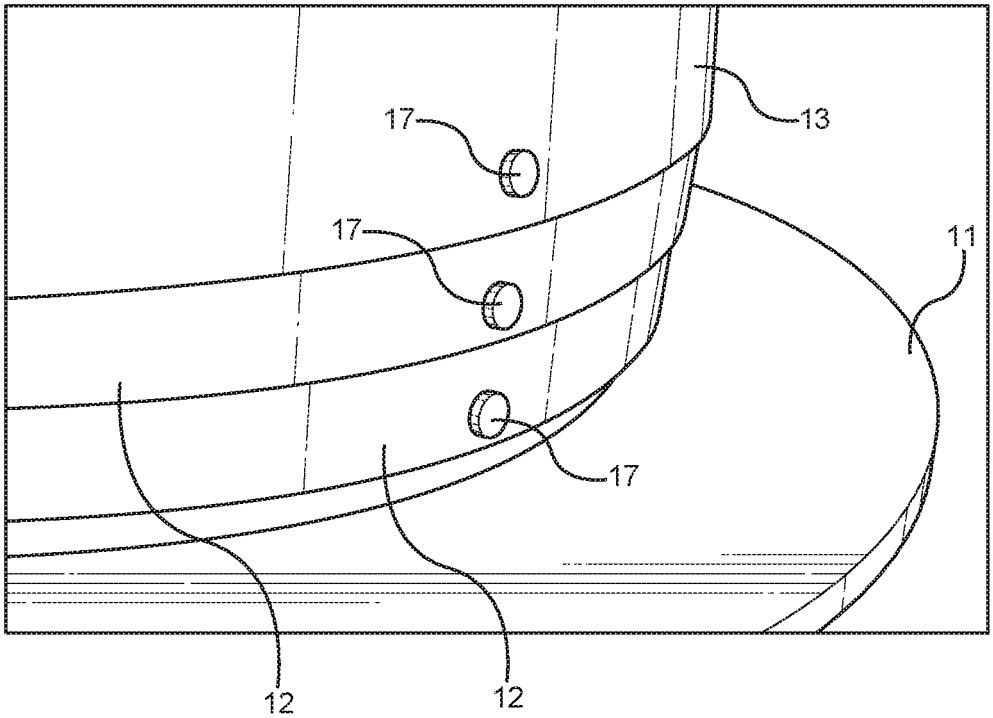
FIG. 4 shows a close up view of an adjustable sidewall of an embodiment of the adjustable bowl receptacle.

Referring now to FIG. 4, there is shown a close up view of an adjustable sidewall of an embodiment of the adjustable bowl receptacle. In the illustrated embodiment, each annular segment of the plurality of annular segments 12 comprises a ball detent 17. The top segment 13 additionally comprises a ball detent 17.

Figure 5:
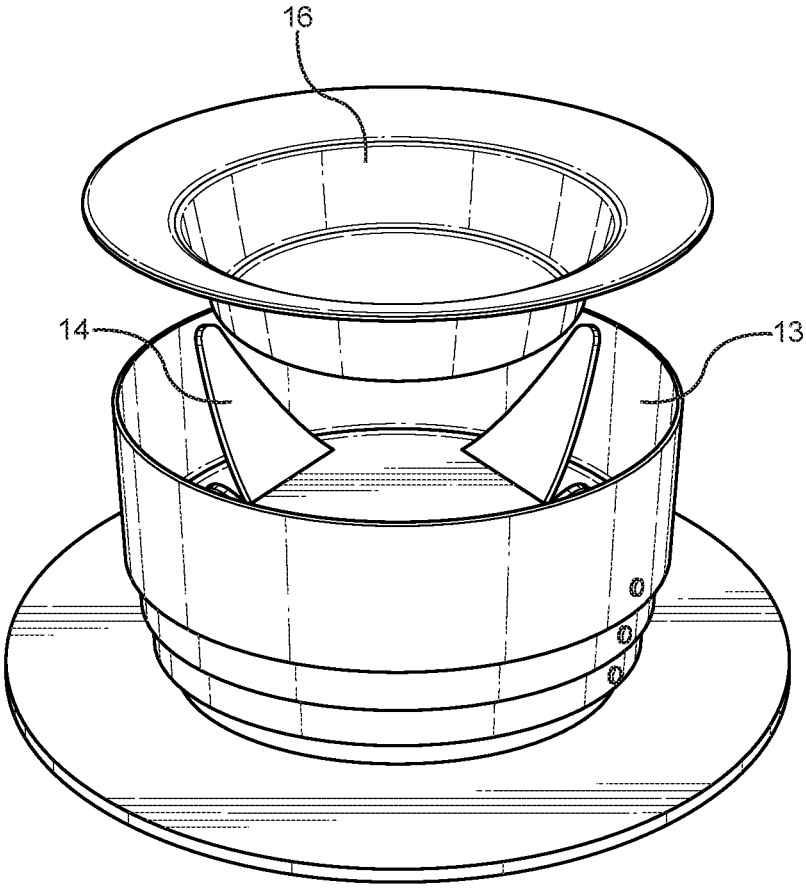
FIG. 5 shows a perspective view of an embodiment of the adjustable bowl receptacle in use.

Referring now to FIG. 5, there is shown a perspective view of an embodiment of the adjustable bowl receptacle in use. In use, a bowl 16 is placed upon the interface at the open upper end of the top segment 13. As such, the bowl 16 can be manipulated by the user in order to achieve a desired position, wherein the contents of the bowl are easily accessible by the user via a utensil, such as a spoon or a fork.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable bowl receptacle comprising:

a planar base;

a plurality of annular segments forming an adjustable sidewall extending upwardly from the planar base;

a top segment in operable connection with the plurality of annular segments defining an open upper end and an interface;

the interface comprising a plurality of flanges disposed around a perimeter of the top segment configured to receive a bowl therein;

wherein each annular segment of the plurality of annular segments and the top segment comprises a locking mechanism;

wherein the locking mechanism is a ball detent.

2. The adjustable bowl receptacle of claim 1, wherein the adjustable sidewall is telescopic.

3. The adjustable bowl receptacle of claim 1, wherein the plurality of annular segments is each curved such that an angle at which the open upper end is oriented is freely movable.

4. The adjustable bowl receptacle of claim 1, wherein a perimeter of the planar base is greater than a perimeter of the open upper end.

5. The adjustable bowl receptacle of claim 1, wherein the planar base is round.

6. An adjustable bowl receptacle comprising:

a planar base;

a plurality of annular segments forming an adjustable sidewall extending upwardly from the planar base;

wherein the plurality of annular segments is each curved such that an angle at which the open upper end is oriented is freely movable;

a top segment in operable connection with the plurality of annular segments defining an open upper end and an interface;

the interface comprising a plurality of flanges disposed around a perimeter of the top segment configured to receive a bowl therein;

wherein the adjustable sidewall is telescopic;

wherein each annular segment of the plurality of annular segments and the top segment comprises a locking mechanism;

wherein the locking mechanism is a ball detent.

* * * * *